US006695672B1

(12) United States Patent
Rehkemper et al.

(10) Patent No.: US 6,695,672 B1
(45) Date of Patent: Feb. 24, 2004

(54) FIGURE WITH PROXIMITY SENSOR

(75) Inventors: Steven Rehkemper, Chicago, IL (US); Dennis O'Patka, Chicago, IL (US); Mike Kass, Willowbrook, IL (US)

(73) Assignee: Rehco, LLC, Chicago, IL (US)

( * ) Notice: Subject to any disclaimer, the term of this patent is extended or adjusted under 35 U.S.C. 154(b) by 0 days.

(21) Appl. No.: 10/440,912

(22) Filed: May 20, 2003

(51) Int. Cl.[7] ..... A63H 3/28
(52) U.S. Cl. ..... 446/298; 446/330; 446/352
(58) Field of Search ..... 446/175, 268, 446/297, 298, 300, 302, 303, 330, 352, 353, 376, 390, 391, 397, 366, 367, 356, 358

(56) References Cited

U.S. PATENT DOCUMENTS 3,159,942 A * 12/1964 Fiske ..... 446/302
4,245,430 A * 1/1981 Hoyt
4,451,911 A * 5/1984 Klose et al. ..... 369/30.02
4,589,138 A * 5/1986 Milner et al. ..... 381/110
4,696,653 A * 9/1987 McKeefery ..... 446/175
4,950,200 A * 8/1990 Curran ..... 446/302
5,324,225 A * 6/1994 Satoh et al. ..... 446/175
5,376,038 A * 12/1994 Arad et al. ..... 446/297

* cited by examiner

*Primary Examiner*—Jacob K. Ackun
*Assistant Examiner*—Bena B. Miller

(57) ABSTRACT

In one embodiment of the present invention there is provided a toy figure having a circuit board to store audio outputs, a speaker to emit the audio outputs, and the ability to activate the playback of the audio outputs. The figure includes a motor mechanism along with the ability to move or pivot the figure's head and/or an appendage attached to the figure. A plurality of switches are positioned about the figure; each switch when triggered, activates controls to move the figure and activates the playback of audio outputs that are incomprehensible to a user. The figure also includes a proximity sensor that is triggered when the figure is in close proximity to an object. When the proximity sensor is triggered, the circuit board is activated to control the movement of the figure and to playback audio outputs that are in a language understandable by the user and played at a low tone such that the user is inclined to move the figure towards the user's ear.

17 Claims, 6 Drawing Sheets

FIGURE WITH PROXIMITY SENSOR

FIELD OF THE INVENTION

The present invention relates to a toy figure with various pre-recorded audio outputs that are played back upon the activation of switches and a proximity sensor.

BACKGROUND OF THE INVENTION

Toy figures have always been the mainstay as toys for young children. Included therewith, are figures that when activated by a user talk or sing in response thereto. For example, in some instances a switch may be placed within the figure that when pressed causes the toy figure to emit various sound bites or noises. In yet other figures, the figure will respond when a magnetic material, placed in another object, is in proximity to a magnetically activated sensor within the toy figure, such as in U.S. Pat. No. 5,603,652, and in commonly assigned U.S. patent application Ser. No. 10/307,578, filed on Dec. 2, 2002.

Nevertheless, there is always a continual need for improvements and novel features not found in the prior art. For example, the ability to provide a figure that includes multiple switches and a proximity sensor that when triggered, after triggering a switch, invokes various responses. The proximity sensor upon activation, after triggering a switch, invokes a response that is comprehendible to a child and at a low level that is audible when the figure is close to the child's ear.

SUMMARY OF THE INVENTION

In one embodiment of the present invention there is provided a toy figure, which includes a body, a head, a tail, and a plurality of legs. The toy figure further includes a motor mechanism to move the head and tail. A circuit board is provided to control the motor mechanism and to store pre-recorded audio outputs that are emitted through a speaker. The toy figure also includes various switches positioned at different locations inside of the toy figure, which when triggered cause the toy figure to respond by emitting one of the audio outputs in a normal or high tone and/or cause the motor mechanism to move the head and tail. A feature of the present invention is that the audio outputs emitted when a switch is triggered are incomprehensible or sounds indicative of the figure's character (for example if the figure is a dog then these audio outputs would be noises and sounds typically made by a dog).

The figure also includes a proximity sensor that upon activation, after a switch is triggered, causes the circuit board to playback and emit through the speaker a low toned pre-recorded audio output or sound, that is audible by placing the figure to the child's ear. The low toned audio output is also in a language understandable by the child, such as English. The proximity sensor is activated when the figure is moved relatively close to an object, such as a child's ear. The child's desire to hear the lower toned sound causes the child to place the figure up against their ear, such that it appears that the toy figure is whispering, in the child's ear, a message only to be heard by the child.

Various proximity sensors may be used such as a photo conductive cell sensor or other light activated sensor. Alternatively, an IR transmitter and receiver may be placed together such that the signal transmitted will be reflected against a surface, such as the child's head, and received by the IR receiver triggering the lower toned response.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE DRAWINGS

Figure 1:
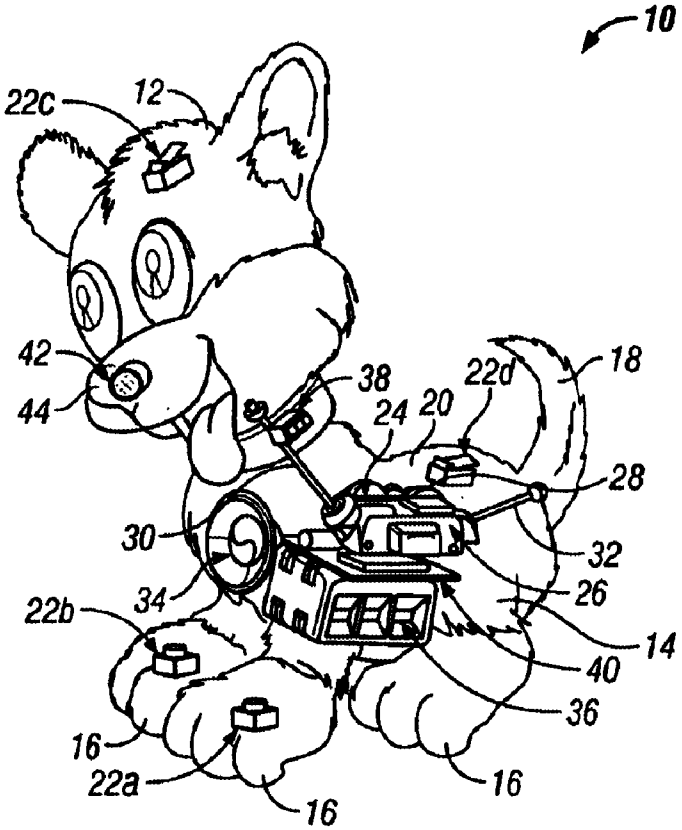
FIG. 1 is a perspective view of a figure in accordance to one embodiment of the present invention showing internal components, including various switches and a proximity sensor.

While the invention is susceptible to embodiments in many different forms, there are shown in the drawings and will be described in detail herein the preferred embodiments of the present invention. It should be understood, however, that the present disclosure is to be considered an exemplification of the principles of the invention and is not intended to limit the spirit or scope of the invention and/or claims of the embodiments illustrated. Referring now to FIG. 1, a toy figure 10 is illustrated along with various internal components. While depicted throughout the drawings as a puppy, the actual external configuration of the toy figure 10 is not material to the scope of the invention. The toy figure may have any configuration along with any number of appendages with or without extremities attached thereto. For example, one can imagine a toy figure configured as a child with two arms and two legs, or a caterpillar with numerous legs, a head and antennae extending therefrom.

The figure 10, in accordance to FIG. 1, includes a head 12, four legs 14 (appendages) with paws 16 (extremities) attached to each leg 14, and a tail 18. The head 12, legs 14, and tail 18 are attached to a body 20 that houses most of the internal components. The figure 10 includes a plurality of switches 22 positioned at various locations within the head 12, extremities 16, and body 20 of the figure 10. For example, the figure 10 includes a pair of squeeze activated switches 22*a* and 22*b* positioned separately in the paws 16, a touch switch 22*c* positioned in the head 12; and a touch switch 22*d* positioned in the body 20. These switches are triggered either by pushing, squeezing, touching, or rubbing the area containing the switch. For example, a child squeezing one of the front paws 16 of the figure would trigger one of the squeeze switches 22*a* or 22*b*, or a child rubbing his/her hand across the top of the head 12 would trigger a touch switch 22*c*, or a child rubbing his/her hand across the backside of the body would trigger touch switch 22*d*. However, other types of well known switches may be employed.

The figure 10 includes a motor mechanism 24 that includes a motor 26 and gear box 28. The motor mechanism 24 includes one or more axles that extend outwardly therefrom to move an appendage or the head. In the present embodiment, the motor mechanism 24 includes a front axle 30 that includes an end attached in the head 12 (the head 12 being pivotally attached to the body 20) such that the head 12 may pivot back and forth in response to controls from the motor 26. A second or rear axle 32 extends from the motor mechanism 24 and has an end attached to the tail 18 (also pivotally attached to the body 20); as such the tail 18 may pivot back and forth in response to controls from the motor 26.

The figure 10 also includes a speaker 34 to emit various pre-recorded sounds. The various components described herein are powered and controlled by a power source 36 (such as a replaceable or rechargeable battery pack) and a circuit board with an appropriate sound chip generally referenced as 40. The sound chip is used to store various pre-recorded sounds, and the circuit board is also used to control the motor mechanism 24 to move the head 12 and tail 18. To turn the figure 10 on a user may switch an on/off switch 38.

In addition to the above switches 22, the toy figure also includes a proximity sensor 42 positioned in a nose 44 defined on the head 12 of the figure 10. The proximity sensor 42 may be a photo conductive cell switch or other type of light activated switch. The proximity sensor 42 is triggered when the nose 44 of the figure 10 is moved close to another object. When the sensor 42 or a switch 22 is triggered, the circuit board 40 activates to emit a pre-recorded audio output through the speaker 34 or activates and controls the motor mechanism 24 in accordance to pre-recorded instructions that move the head 12 and/or tail 18.

Figure 2A:
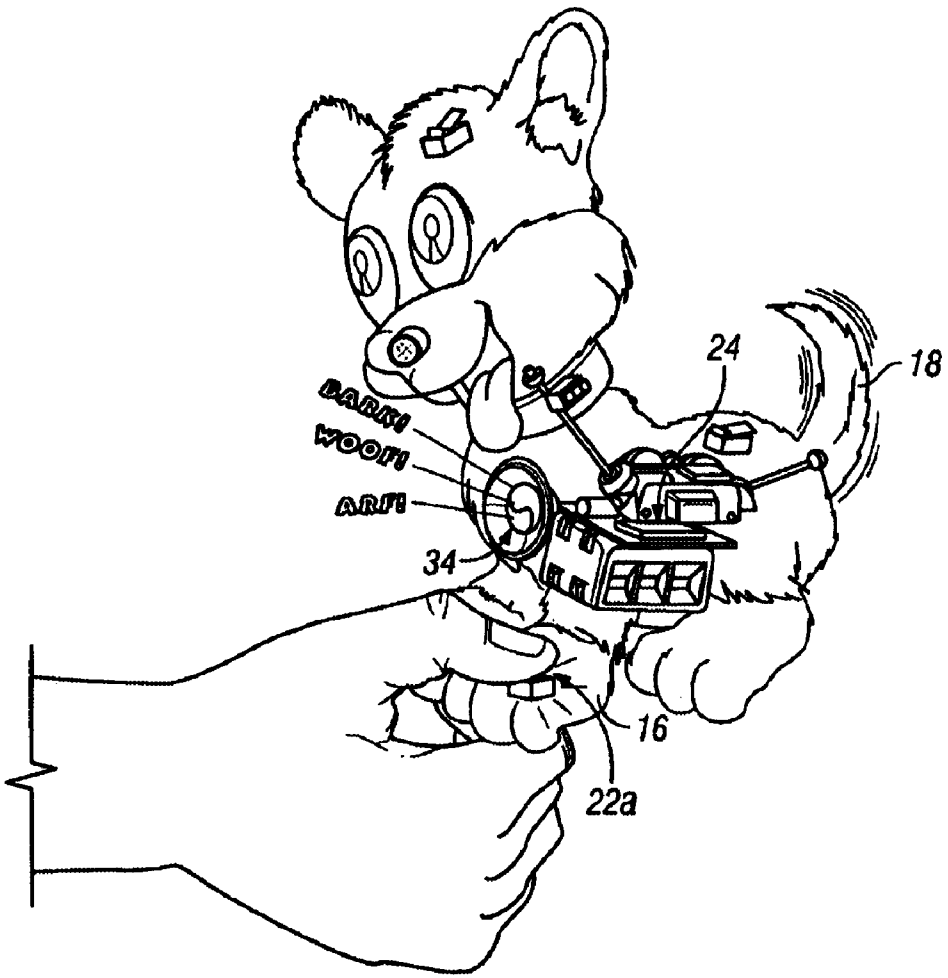
FIGS. 2*a* and 2*b* are perspective views of the figure with a user triggering switches that are triggered when the user pushes the area containing the switches and which when triggered activate responses both audible and motion.
Figure 2B:
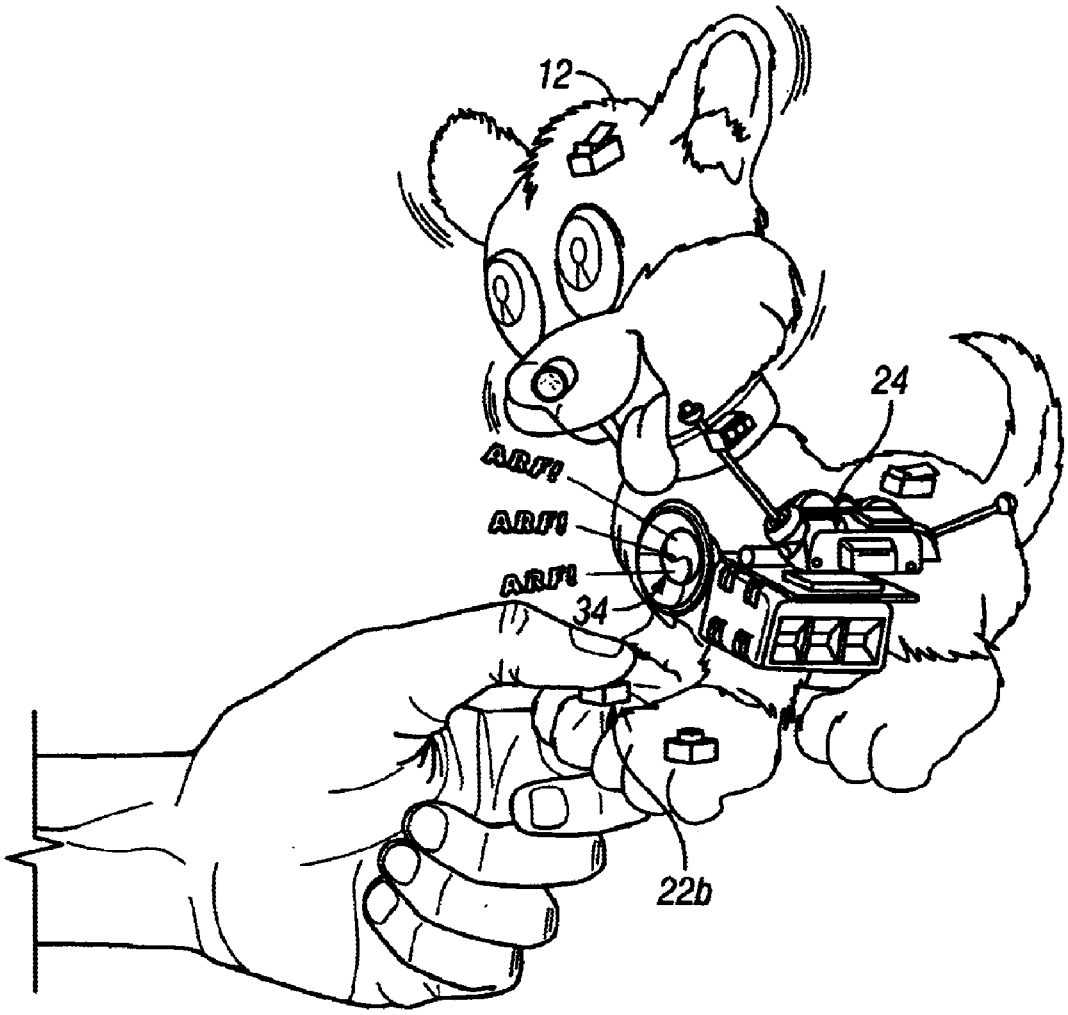
Figure 3A:
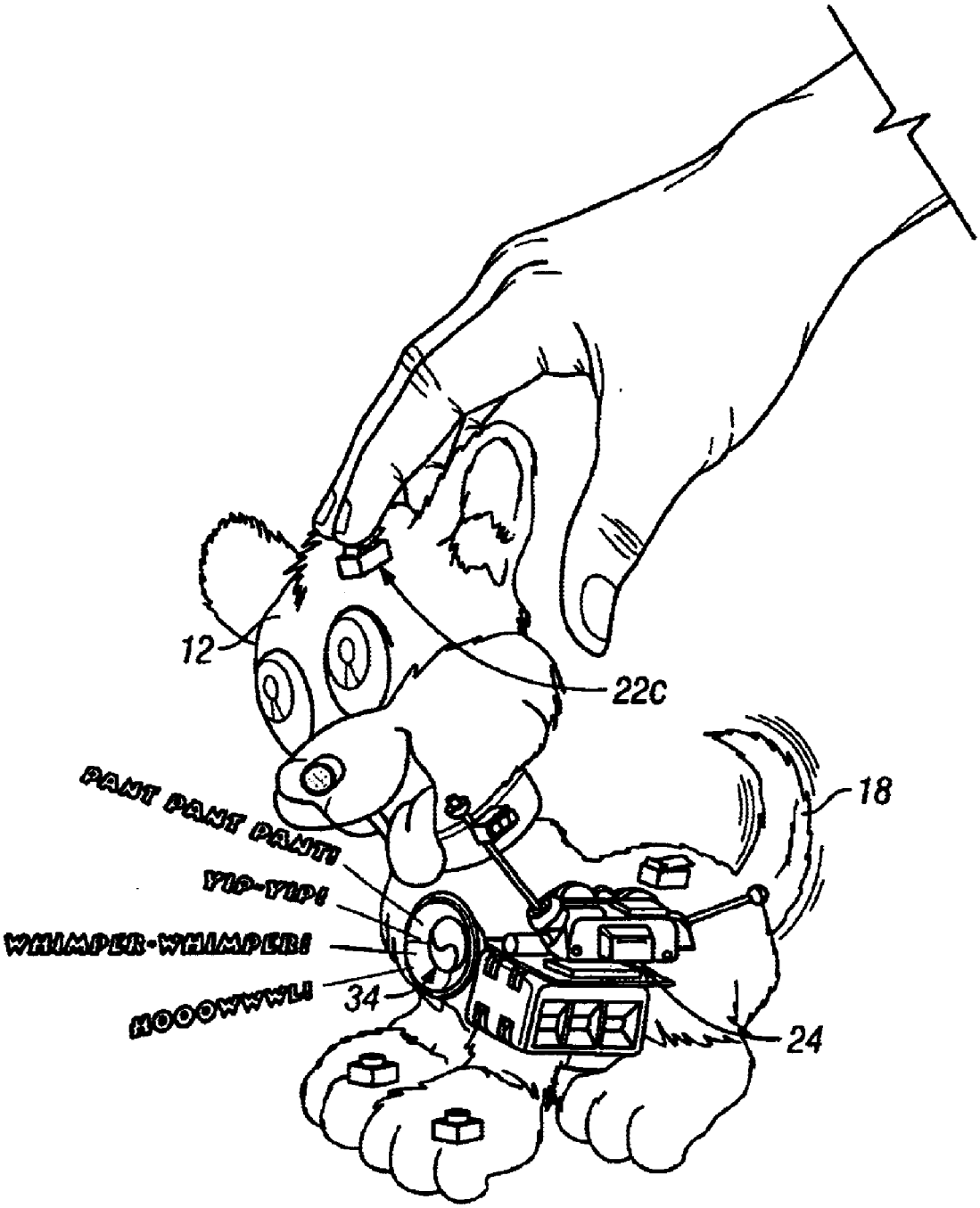
FIGS. 3*a* and 3*b* are additional perspective views of the figure with a user triggering switches that are triggered when the user rubs an area containing the switches and which when triggered activate responses both audible and motion.
Figure 3B:
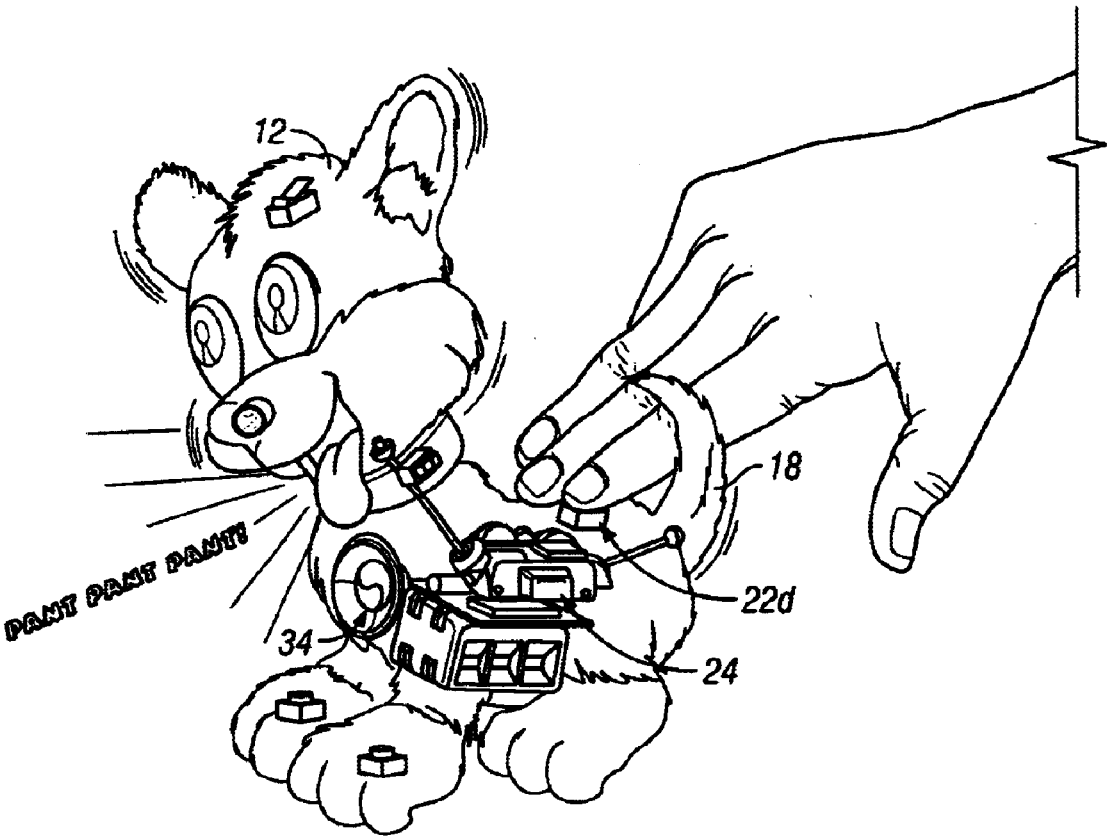
Figure 4:
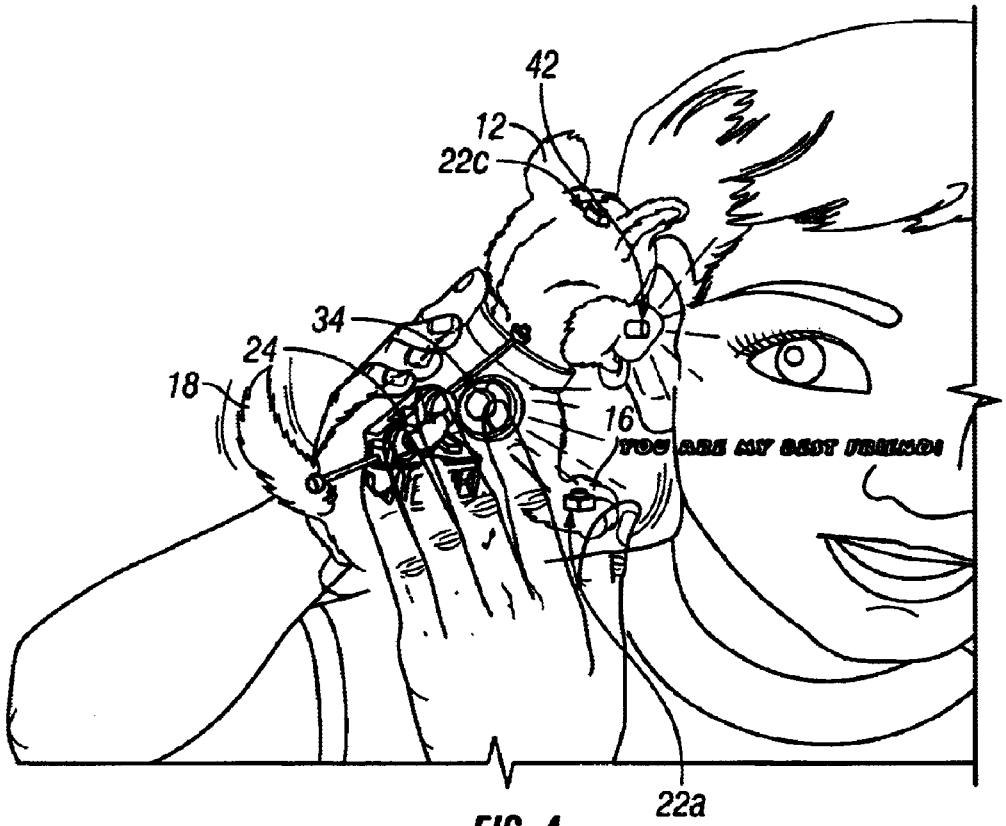
FIG. 4 is a perspective view of the figure being held up against a user to trigger a proximity sensor that when triggered activates yet a different response.

Referring now also to FIGS. 2–4, when the figure is turned on, and a switch 22 or sensor 42 is triggered, different pre-recorded audio outputs or motions are provided in response thereto. For example, in one instance (FIG. 2*a*) a child may squeeze a first switch 22*a* in one of the paws 16 triggering the first switch 22*a* and activating a response or set of responses. The response in this instance may be various audio outputs emitted through the speaker 34 and the motor mechanism 24 pivoting or wagging the head 12 and/or tail 18. Subsequent triggering of the first switch 22*a* may invoke a different response selected randomly or scrolled through a set of responses. In another example (FIG. 2*b*) a child may squeeze a second switch 22*b* in another paw 16 triggering the last response invoked by the previous switch 22, or may invoke different sounds and motion. In a third example (FIG. 3*a*) a child may rub or pat the head 12 of the figure 10 triggering the head switch 22*c* and causing the figure 10 to invoke another response which may be selected from the same or different set of responses. In yet another example (FIG. 3*b*), a child rubbing or patting the backside of the figure 10 triggers a fourth switch 22*d* causing the figure 10 to invoke another response. It is further understood, that each subsequent triggering of a switch may simply invoke another response (or a random response) from a single set of responses.

It has been shown that various switches positioned about the figure when activated invoke responses that may be audible and/or motion. The audible responses more importantly are audio outputs indicative of the character of the figure, for example, the figure 10 as illustrated is a dog which would include sounds typically made by a dog, such as barking, panting, whimpering, and/or howling. These audio outputs are also incomprehensible by a person. As used throughout, the word "incomprehensible" denotes that "the sounds have no meaning to the listener or in a language not understandable by the listener". As such, it would be desirable to also have some of the audio outputs in a language understandable by the child and in a manner that the child thinks the figure 10 was secretly talking directly and only to the child.

Turning now to FIG. 4, the figure 10 also includes a proximity sensor 42 which when triggered invokes a secondary response. The secondary response includes audible low toned audio outputs in a language understandable by a child, and may include motion of the head 12 and/or tail 18. The tone is also such that the child is inclined to bring the figure 10 to the child's ear, making the child think the figure 10 is whispering and only speaking to the child. The proximity sensor 42 in this embodiment is a photo conductive cell switch or other light activated switch.

Figure 5:
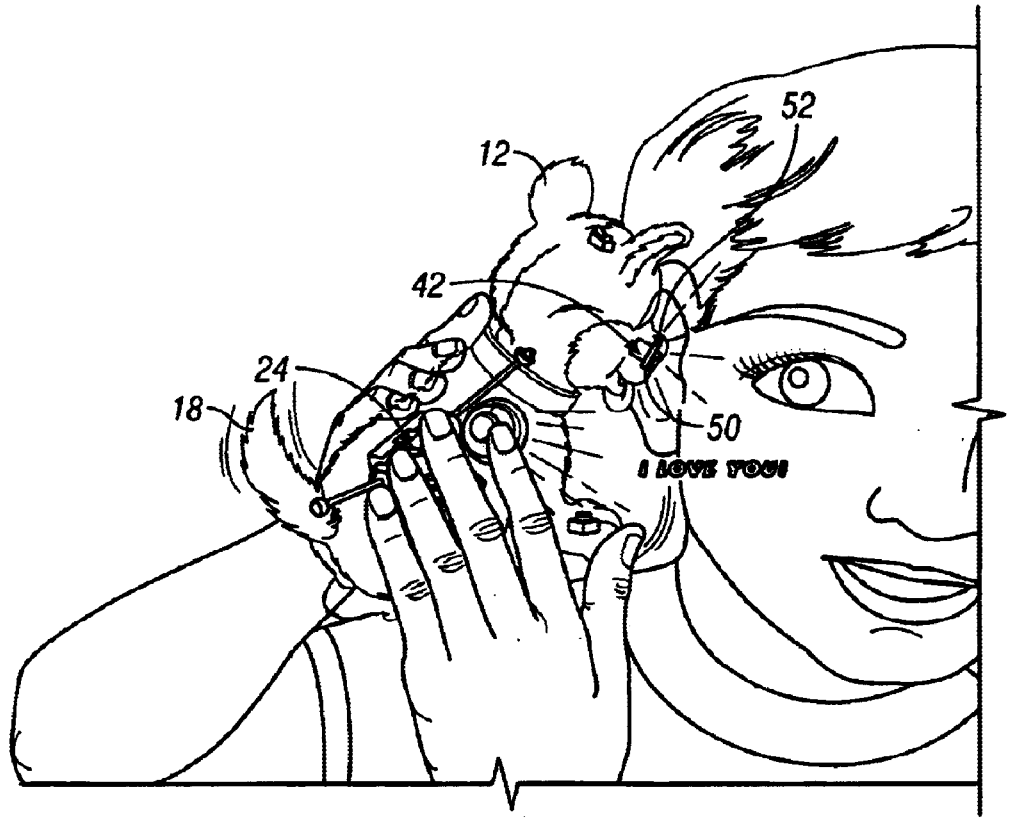
FIG. 5 is a perspective view of another embodiment of the figure also being held up against a user to trigger a differently configured proximity sensor.

In another embodiment, FIG. 5, the proximity sensor 42 includes an IR transmitter 50 and an IR receiver 52 adjacently positioned. When the figure 10 is positioned close to a child's ear, the IR receiver 52 receives it own signal transmitted from the IR transmitter 50 and bounced off of the child. The triggering of this sensor again activates the secondary response (low toned comprehensible sounds as well as motion).

Figure 6:
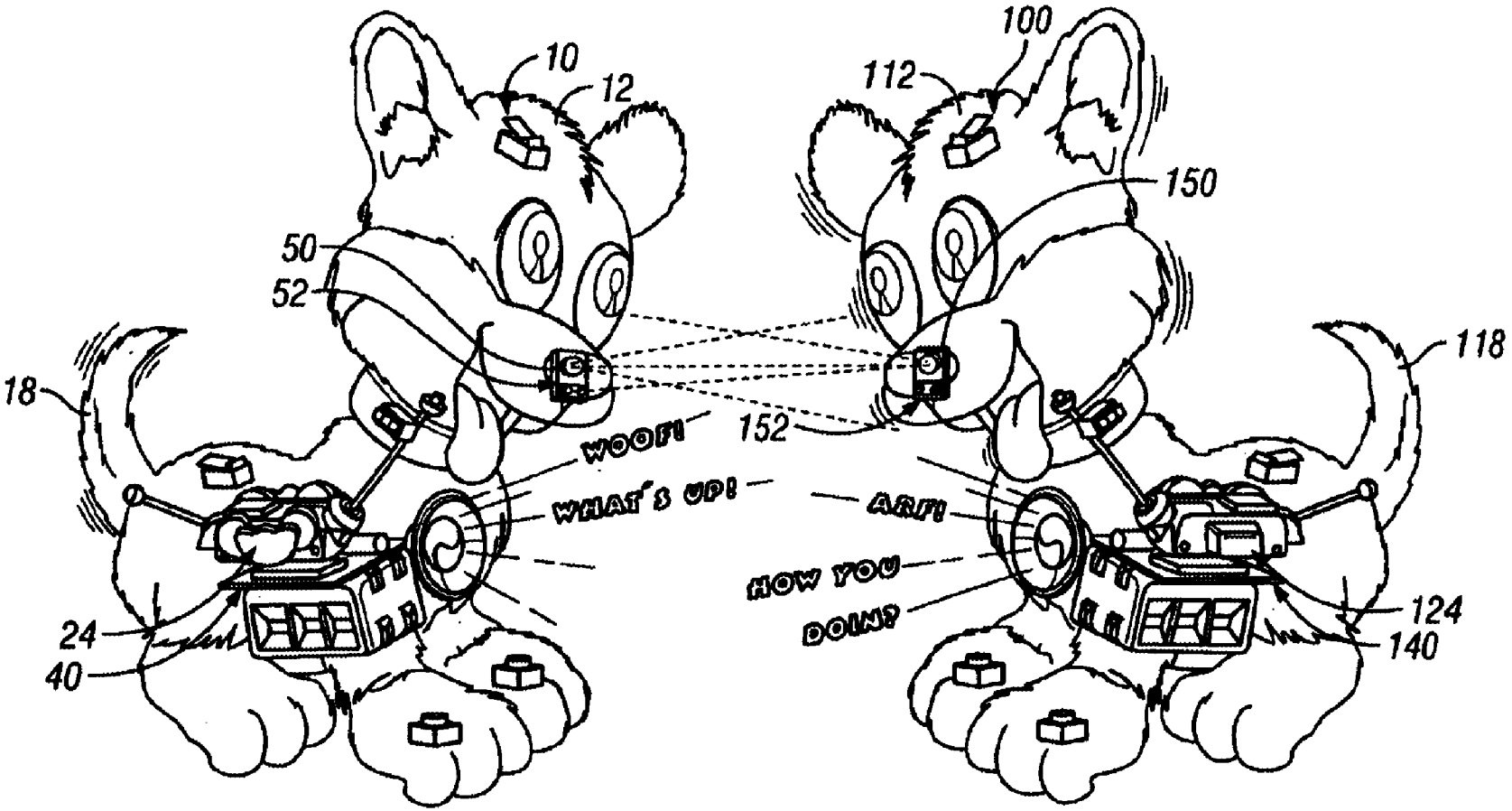
FIG. 6 is a perspective view of two figures similarly configured and which when in proximity of each other, the proximity sensors are triggered to activate a response.

In yet another embodiment, FIG. 6, the IR receiver 52 may also recognize a signal from a second similarly configured figure 100. In this instance, a second figure 100 has an IR transmitter 150 and receiver 152. When the two figures (10 and 100) are in proximity of each other, the IR receivers 52 and 152 receive the other figure's IR signal. The circuit boards (40 from the first figure 10 and 140 from the second figure 100) include programming that allows it to recognize and distinguish an IR signal from a different figure as opposed to its own IR signal bounced off of an object and thus will invoke yet a different set of responses. In this embodiment, the figures emit audio outputs incomprehensible to a listener (such as barking) but also audio outputs understandable by the listener (such as "How You Doin'?" or "What's going on?") at a normal tone or volume. The child would think the two figure's were talking to each other and also translating such that the child is able to understand the two figures. The response may also include the respective motor mechanisms 24 or 124 moving the figure's 10 or 100 head 12 or 112 and/or tail 18 or 118.

It is further noted that in this embodiment when the figure 10 or 100 is moved towards an other object, the IR receiver (52 or 152) will receive the figure's (10 or 100) own signal bounced off of the object causing the respective circuit board 40 or 140 to invoke the secondary low toned audible and comprehendible sounds.

In the preferred embodiment, the proximity sensor when activated, only triggers a secondary response when the proximity sensor is activated subsequent to the activation of a switch. The circuit board would include programming instructions, to track and determine if the proximity sensor is activated after the activation of a switch. As such, repeated activation of the proximity sensor would not invoke another response, or may only invoke the same previous response repeatedly. As such during operation, the user first activates a switch to invoke an incomprehensible normal or high toned audible response. If immediately following the activation of the switch, the user brings the figure close to the user's ear, the proximity sensor will activate. The sequent activation of the proximity sensor triggers a secondary response that is low toned and in a language that is comprehensible to the user, such that the user believe the figure is talking secretively to the user.

From the foregoing and as mentioned above, it is observed that numerous variations and modifications may be effected without departing from the spirit and scope of the novel concept of the invention. It is to be understood that no limitation with respect to the embodiments illustrated herein is intended or should be inferred. It is intended to cover, by the appended claims, all such modifications within the scope of the appended claims.

We claim:

1. A toy figure having a body, a head and an appendage extending therefrom, the figure further comprising:

a circuit board to store a primary audio output incomprehensible to a listener and to store a secondary audio output in a language understandable to the listener;

a speaker connected to the circuit board for emitting audio outputs;

a manual switch positioned about the figure which when triggered activates the circuit board to emit the primary audio output at a first volume; and a proximity sensor positioned about the figure that is triggered when the figure is in close proximity to an object, when the proximity sensor is triggered the circuit board is activated to emit the secondary audio output at a second volume significantly lower than the first volume, wherein the listener is inclined to bring the figure closer to the listener retriggering the proximity sensor.

2. The figure of claim 1, wherein the circuit board includes programming to emit the secondary audio output upon triggering the proximity sensor after the triggering of the manual switch.

3. The figure of claim 1 further comprising:

a motor mechanism positioned in the body and having a rotatable axle extending therefrom for pivoting the head and wherein the circuit board includes the ability to control the motor mechanism when the circuit board is activated by the triggering of the switch or proximity sensor.

4. The figure of claim 3, wherein the circuit board stores a set of primary audio outputs incomprehensible to a listener, stores a set of secondary audio outputs in a language understandable to the listener and the circuit board selects one from the set of primary audio outputs when the switch is triggered and selects one from the set of secondary audio outputs when the proximity sensor is triggered.

5. The figure of claim 4, wherein the proximity sensor is a light activated sensor.

6. The figure of claim 4, wherein the proximity sensor is a photo conductive sensor.

7. The figure of claim 4, wherein the proximity sensor is defined by an IR transmitter and an IR receiver adjacently positioned such that the IR receiver is capable of receiving a signal transmitted from the IR transmitter and bounced off of the object in close proximity to said sensor.

8. The figure of claim 7, wherein the circuit board includes a means for recognizing a signal transmitted from a second IR transmitter contained in a second figure similarly configured, the circuit board including instructions that when said circuit board receives said signal transmitted from a second IR transmitter, the circuit board is to emit an audio output selected from said set of secondary audio outputs at a volume substantially equal to said first volume.

9. A toy figure having a body, a head, a tail and legs extending therefrom, the figure further comprising:

a motor mechanism positioned in the body and having two rotatable axles extending therefrom for separately pivoting the head or tail;

a circuit board to store a set of primary audio outputs incomprehensible to a listener, to store a set of secondary audio outputs in a language understandable to the listener, and to control the motor mechanism;

a speaker connected to the circuit board for emitting audio outputs;

a plurality of switches separately positioned about the figure and legs which when triggered activates the circuit board to emit one of the primary audio outputs at a first volume and/or to control the motor mechanism for pivoting the head and/or tail; and a proximity sensor positioned about the figure that is triggered when the figure is in proximity to an object, when the proximity sensor is triggered the circuit board is activated to emit one of the secondary audio outputs at a second volume significantly lower than the first volume.

10. The figure of claim 9, wherein when the proximity sensor is triggered the circuit board further includes programming to emit one of the secondary audio outputs if one of the switches is triggered prior to the triggering of the proximity sensor.

11. The figure of claim 9, wherein the proximity sensor is a light activated sensor.

12. The figure of claim 9, wherein the proximity sensor is a photo conductive sensor.

13. The figure of claim 9, wherein the proximity sensor is defined by an IR transmitter and an IR receiver adjacently positioned such that the IR receiver is capable of receiving a signal transmitted from the IR transmitter and bounced off of the object in proximity to said sensor.

14. The figure of claim 13, wherein the circuit board includes a means for recognizing a signal transmitted from a second IR transmitter contained in a second figure similarly configured, the circuit board including instructions that when said circuit board receives said signal transmitted from a second IR transmitter, the circuit board is to emit an audio output selected from said set of secondary audio outputs at a volume substantially equal to said first volume.

15. A toy figure having a switch and a proximity sensor, the figure further comprising:

a circuit board to store a primary set of audio outputs incomprehensible to a listener and the circuit board further causes to emit through a speaker at a first volume a audio output selected from said primary set when the switch is triggered;

the circuit board further stores a secondary set of audio outputs in a language understandable to the listener;

the proximity sensor includes an IR transmitter and an IR receiver adjacently positioned such that the IR receiver is capable of receiving a signal transmitted from the IR transmitter and bounced off of an object in proximity to said sensor; and when the proximity sensor receives the signal transmitted from said IR transmitter the circuit board is activated to emit a sound bit selected from said secondary set at a second volume significantly lower than the first volume.

16. The figure of claim 15, wherein when the proximity sensor is triggered the circuit board further includes programming to emit one of the secondary audio outputs if one of the switches is triggered prior to the triggering of the proximity sensor.

17. The figure of claim 16, wherein the circuit board includes a means for recognizing a signal transmitted from a second IR transmitter contained in a second figure similarly configured, the circuit board including instructions that when said circuit board receives said signal transmitted from a second IR transmitter, the circuit board is to emit an audio output selected from said set of secondary audio outputs at a volume substantially equal to said first volume.

* * * * *